US011798516B2

(12) United States Patent
Jia

(10) Patent No.: US 11,798,516 B2
(45) Date of Patent: Oct. 24, 2023

(54) METHOD AND DEVICE FOR ADJUSTING DISPLAY BRIGHTNESS, MOBILE TERMINAL AND STORAGE MEDIUM

(71) Applicant: BEIJING XIAOMI MOBILE SOFTWARE CO., LTD., Beijing (CN)

(72) Inventor: Yongqiang Jia, Beijing (CN)

(73) Assignee: BEIJING XIAOMI MOBILE SOFTWARE CO., LTD, Beijing (CN)

( * ) Notice: Subject to any disclaimer, the term of this patent is extended or adjusted under 35 U.S.C. 154(b) by 0 days.

(21) Appl. No.: 17/519,555

(22) Filed: Nov. 4, 2021

(65) Prior Publication Data

US 2022/0310034 A1 Sep. 29, 2022

(30) Foreign Application Priority Data

Mar. 29, 2021 (CN) ..... 202110335663.9

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01)

(58) Field of Classification Search
CPC ..... G09G 5/10; G09G 2320/0626; G09G 2360/144; G09G 2320/0233; G09G 2320/0686; G09G 2330/021
See application file for complete search history.

(56) References Cited

U.S. PATENT DOCUMENTS

2009/0278828 A1* 11/2009 Fletcher ..... G09G 3/3406 455/566
2012/0256859 A1* 10/2012 Noma ..... G09G 5/003 345/173
2015/0331654 A1* 11/2015 Luttrell ..... G06F 3/1446 345/1.3
2018/0151131 A1 5/2018 Files et al.
2019/0278323 A1* 9/2019 Aurongzeb ..... G06F 1/3265
2020/0135147 A1* 4/2020 Tang ..... G09G 3/3208
2020/0264773 A1* 8/2020 Kim ..... G06F 8/38
2020/0402477 A1* 12/2020 Jiang ..... G06F 3/013

FOREIGN PATENT DOCUMENTS

EP 2738759 A1 6/2014

OTHER PUBLICATIONS

Samsung Galaxy Z Fold2 5G—Samsung Canada, https://www.samsung.com/ca/smartphones/galaxy-z-fold2/, (21p).
Extended European Search Report of EP Application No. 21208933.8 dated May 6, 2022, (9p).

* cited by examiner

*Primary Examiner* — Rodney Amadiz
(74) *Attorney, Agent, or Firm* — Arch & Lake LLP

(57) ABSTRACT

The present disclosure discloses a method and device for adjusting display brightness, a mobile terminal, and a storage medium. The method is applied to a mobile terminal including at least two display screens. and the method includes: detecting that a specific application mode has been entered; obtaining use state information of the at least two display screens; and adjusting a display brightness value of at least one display screen according to the use state information.

11 Claims, 4 Drawing Sheets

METHOD AND DEVICE FOR ADJUSTING DISPLAY BRIGHTNESS, MOBILE TERMINAL AND STORAGE MEDIUM

CROSS-REFERENCE TO RELATED APPLICATION

This application is based on and claims priority to the Chinese Patent Application NO. 202110335663.9, filed on Mar. 29, 2021, the content of which is incorporated herein by reference in its entirety for all purposes.

TECHNICAL FIELD

The present disclosure relates to the field of terminal technologies, and in particular to a method and device for adjusting display brightness, a mobile terminal, and a storage medium.

BACKGROUND

Mobile terminals (such as mobile phones, tablet computers) are widely used in people's work and life. In order to meet more people's needs, some mobile terminals are equipped with multiple screens. However, during the use of the multiple screens, brightness adjustment is uniform. In other words, for the brightness adjustment of the multiple screens, the brightness adjustment of all screen is triggered. Obviously, this unified brightness adjustment method is not conducive to the use of users, and may cause more energy consumption due to unnecessary brightness adjustment.

SUMMARY

Examples of the present disclosure provide a method and device for adjusting display brightness, a mobile terminal, and a storage medium.

According to a first aspect of the present disclosure, there is provided a method for adjusting display brightness, which is applied to a mobile terminal including at least two display screens, and includes: detecting that a specific application mode has been entered; obtaining use state information of the at least two display screens; and adjusting a display brightness value of at least one display screen according to the use state information.

According to a second aspect of the present disclosure, there is provided a mobile terminal and the mobile terminal includes: a processor; and a memory for storing executable instructions of the processor; wherein, the processor is configured to execute following operations when executing the executable instructions: detecting that a specific application mode has been entered; obtaining use state information of the at least two display screens; and adjusting a display brightness value of at least one display screen according to the use state information.

According to a third aspect of the present disclosure, there is provided a non-transitory computer-readable storage medium having a computer program stored thereon, wherein the program, when executed by a processor, implements steps of the method described in the first aspect of the present disclosure.

It should be noted that the above general description and the following detailed description are merely exemplary and explanatory and should not be construed as limiting of the disclosure.

BRIEF DESCRIPTION OF THE DRAWINGS

The accompanying drawings, which are incorporated in and constitute a part of the disclosure, illustrate examples consistent with the present disclosure and, together with the description, serve to explain the principles of the present disclosure.

DETAILED DESCRIPTION

Figure 1:
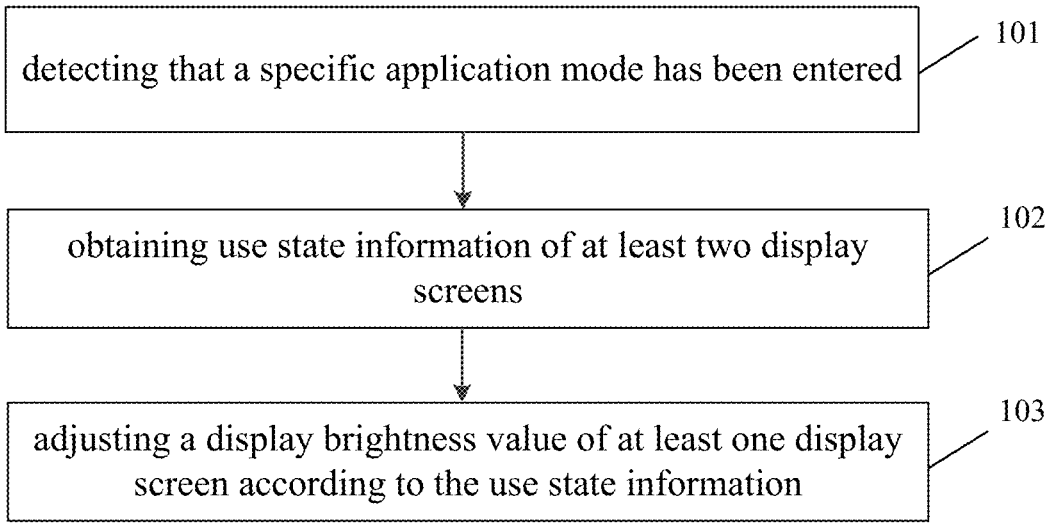
FIG. 1 is a flowchart showing a method for adjusting display brightness in accordance with one or more examples of the present disclosure.

Reference will now be made in detail to embodiments, examples of which are illustrated in the accompanying drawings. The following description refers to the accompanying drawings in which the same numbers in different drawings represent the same or similar elements unless otherwise represented. The implementations set forth in the following description of embodiments do not represent all implementations consistent with the present disclosure. Instead, they are merely examples of devices and methods consistent with aspects related to the present disclosure as recited in the appended claims.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

The terms "module," "sub-module," "circuit," "sub-circuit," "circuitry," "sub-circuitry," "unit," or "sub-unit" may include memory (shared, dedicated, or group) that stores code or instructions that can be executed by one or more processors. A module may include one or more circuits with or without stored code or instructions. The module or circuit may include one or more components that are directly or indirectly connected. These components may or may not be physically attached to, or located adjacent to, one another.

A unit or module may be implemented purely by software, purely by hardware, or by a combination of hardware and software. In a pure software implementation, for example, the unit or module may include functionally related code blocks or software components, that are directly or indirectly linked together, so as to perform a particular function.

FIG. 1 is a flowchart showing a method for adjusting display brightness in accordance with an example of the present disclosure. As shown in FIG. 1, the method is applied to a mobile terminal including at least two display screens, and the method includes the following steps:

in step 101, it is detected that a specific application mode has been entered;

in step 102, use state information of the at least two display screen is obtained; and in step 103, a display brightness value of at least one display screen is adjusted according to the use state information.

Here, the mobile terminal may be at least one of a mobile phone, a tablet computer, a wearable device, and a smart device. The wearable device may be a smart watch or a smart bracelet, and the smart device may be a smart speaker or a smart camera. In some examples, the mobile terminal may be a double-screen mobile phone, a multi-screen mobile phone, a surround screen mobile phone, or the like. In short, the mobile terminal described in the examples refers to a mobile terminal having the at least two display screens on which brightness adjustment can be implemented.

It should be noted that the at least two display screens can be two display screens that are physically separated from each other. For example, for the double-screen mobile phone with a front display screen and a rear display screen, the front display screen and the rear display screen are the two display screens that are physically separated from each other.

In other examples, the at least two display screens may also be at least two logical screens covering different surfaces formed by bending and extending the same display screen. Different logical screens are actually display areas of the same physical screen on different surfaces of the device. For example, for the surround screen mobile phone, adjacent display screens may be the logical screens on different surfaces formed by bending and extending each other.

Here, the specific application mode refers to a mode in which the brightness of the display screen can be independently adjusted when the brightness of the display screen is intended to be performed.

In some examples, the method further includes:

obtaining configuration information for a brightness adjustment mode, and the configuration information refers to preset information that can allow different display screens of the mobile terminal to be adjusted the brightness independently;

the detecting that the specific application mode has been entered may include:

detecting that the specific application mode has been entered according to a brightness adjustment instruction, if the configuration information indicates that the mobile terminal allows the different display screens to be adjusted the brightness independently.

The brightness adjustment instruction may be an instruction for controlling the mobile terminal to brighten the display brightness of the display screen, and may also be an instruction for controlling the mobile terminal to darken the display brightness of the display screen. It is understandable that when the display brightness of the display screen is insufficient to make the user see a display picture on the display screen clearly, it is usually necessary to brighten the display brightness of the display screen; and when the display brightness of the display screen may be dazzling for user's eyes, it is usually necessary to darken the display brightness of the display screen.

In some examples, a brightness adjustment event may be manually triggered by the user. For example, the brightness adjustment event is triggered by the user through an input operation on a virtual control for brightness adjustment. In this way, the user can manually adjust the brightness of the display screen according to the current viewing experience, so as to meet viewing demands of the user for the display screen.

In some examples, the method further includes:

detecting that an input operation has been performed, and the input operation is detected through the virtual control for brightness adjustment of the mobile terminal; and determining to generate the brightness adjustment instruction.

In other examples, the brightness adjustment instruction may also be automatically triggered by the mobile terminal based on external environment brightness. It is understandable that in a case where the external environment brightness is too bright, if the display brightness of the display screen is insufficient, it may cause that the user may not be able to see the display picture on the display screen clearly in the environment where the external environment brightness is too bright, and thus, it is necessary to brighten the display brightness of the display screen in this case; and in a case where the external environment brightness is too dark, if the display brightness of the display screen is relatively bright, it may cause excessive light to enter the user's eyes, causing a glare phenomenon, etc., and thus, it is necessary to darken the display brightness of the display screen in this case. In this way, the mobile terminal can intelligently adjust the display brightness of the display screen based on the external environment brightness, thereby reducing the user's manual adjustment operation on the display brightness of the display screen, and improving the intelligence of the mobile terminal.

In some examples, the method further includes:

detecting the external environment brightness through a light sensor, and according to the external environment brightness, determining to generate the brightness adjustment instruction if brightness change amount of the external environment brightness is greater than a preset brightness amount.

The preset brightness amount here can be a preset brightness change amount that can automatically trigger the adjustment of the display brightness of the display screen. For example, setting the preset brightness amount to 200 lux means that when the brightness change amount of the external environment brightness is greater than 200 lux, the mobile terminal will be triggered to adjust the display brightness of the display screen adaptively. In some examples, the preset brightness amount can be set according to adjustment needs of different users. For visually sensitive users, the preset brightness amount can be set smaller, so that the mobile terminal is more sensitive to the change of the external environment brightness, which is conducive to the visual experience of the visually sensitive users; and for visually insensitive users, the preset brightness amount can be set larger, which can reduce computing load of the mobile terminal caused by the adjustment based on the external brightness change and energy consumption caused by frequent adjustments, thereby saving the energy consumption of the mobile terminal.

In some examples, the step 101, that is, the detecting that the specific application mode has been entered, may include:

detecting that a trigger event has occurred, and the trigger event is in response to the mobile terminal having entered the specific application mode, the specific application mode needs the at least two display screens to display different display brightness values, and the at least two display screens display different applications, or display different interfaces of the same application.

In some examples, the specific application mode refers to a mode of entering a first specific application. The first specific application here can trigger the display screen to be adjusted the brightness independently.

The trigger event here refers to an event that can trigger the mobile terminal to enter the first specific application. In some examples, the trigger event may be a click event on an icon of the first specific application, and may also be an automatic trigger event for the first specific application. In some examples, the automatic trigger event for the first specific application may include a timing starting event of the first specific application, and may also include trigger starting events of other applications associated with the first specific application, for example, a starting event of automatically jumping from a certain link or control of application A to application B, etc. Please note that any trigger event that can trigger to enter the first specific application belongs to the trigger event described in the examples.

It is understandable that different applications have different requirements for the display brightness. For example, for some large competitive game applications, strong visual stimulation is needed, and accordingly, such applications have higher requirements for the display brightness and need higher display brightness. For some text or light life applications, for example, sleep aid applications, the requirements for the display brightness are low, and lower display brightness is needed. Therefore, when the trigger event triggers to start the above-mentioned first specific application, it is determined that the specific application mode has been entered.

In other examples, the specific application mode refers to a mode of entering a specific page of a second specific application. The specific page of the second specific application here can trigger the display screen to be adjusted the brightness independently.

The trigger event here refers to an event that can trigger the mobile terminal to enter the specific page of the second specific application. In some examples, the trigger event may be a starting event for the specific page of the second specific application, for example, clicking the link or the virtual control in the second specific application that is linked to the specific page. Please note that any trigger event that can trigger to enter the specific page of the second specific application belongs to the trigger event described in the examples.

It should be understood that different application pages of the same application may have different requirements for the display brightness. For example, in a photographing scenario, when the user needs to preview a photographed image, a preview page is needed to have a higher display brightness, so that the user can see the preview image in the preview page clearly. For another example, in a payment scenario, since a two-dimensional code page of a payment application requires higher display brightness when the two-dimensional code is scanned in order to increase a scanning success rate. Therefore, when the trigger event triggers to start of the specific page of the second specific application, it is determined that the specific application mode has been entered.

Here, the first specific application and the second specific application may be the same or different.

In the examples of the present disclosure, according to the trigger event, the entry to the first specific application or the specific page of the second specific application is triggered to trigger the entry to the specific application mode, so that the display screen can be adjusted the brightness independently based on the specific application mode, which is beneficial to the user's visual experience. In addition, it is an automatic entry based on the trigger event of the application or the application page without the manual brightness adjustment by the user for the first specific application or the specific page of the second specific application, thereby more intelligently adjusting the display brightness of each display screen and facilitating the use experience of the user.

In some examples, the step 102, that is, the obtaining the use state information of the at least two display screens, may include:

identifying at least one of current display states and current display content information of the at least two display screens; and determining the use state information according to the at least one of the current display states and the current display content information.

Here, the use state information can be obtained from a system operating program. The current display state and/or the current display content information corresponding to the display screen can be found in the system operating program.

Here, the current display state may include: a bright screen state and a sleep state. In some examples, according to the display state of the display screen, it is determined that the current display state of the display screen is the bright screen state, and the display brightness of the display screen can be adjusted according to the bright screen state of the display screen. In some examples, according to the display state of the display screen, it is determined that the current display state of the display screen is the sleep state, and the display brightness of the display screen can be maintained according to the sleep state of the display screen, so that an original brightness setting can be maintained when the display screen in the sleep state, thereby ensuring the user's visual experience, and reducing a problem of poor visual experience caused by giving the user an untimely brightness caused by a bright screen due to the brightness adjustment of the display screen in the sleep state.

The display content information may include the currently displayed application or a page of the currently displayed application. In some examples, according to the display content information, it is determined that an application currently displayed on the display screen is the above-mentioned first specific application, and the display brightness of the display screen can be adjusted according to the use state of the display screen. In some examples, according to the display content information, it is determined that the application currently displayed on the display screen is an application page of the above-mentioned second specific application, and the display brightness of the display screen can be adjusted according to the use state of the display screen.

As an optional example, the adjusting the display brightness value of the at least one display screen according to the use state information may include:

simultaneously adjusting display brightness values of all display screens according to the use state information, and different display screens have different display brightness values.

It is understandable that different brightness value adjustments can be provided according to different display states in the use state information of the display screen. For example, a brightness value adjustment can be performed on a display screen that is in a display state, and no adjustment can be performed on a display screen that is not displaying. In addition, the different brightness value adjustments can be provided according to different display content information in the use state information of the display screen. For example, in the above scenario, a high brightness adjustment can be performed on a display screen that displays the two-dimensional code for payment, and an adaptive adjustment based on the current environment can be performed on a display screen that does not display the two-dimensional code for payment.

In short, in the examples, different brightness values can be provided according to different use state information of the display screen, so as to satisfy the current use state information of the display screen, and further satisfy the user's visual experience under the current use state information. Moreover, since the brightness value of the display screen can be adjusted intelligently according to the use state information, the user does not need to manually adjust the brightness value of each display screen, thereby reducing the manual operation of the user and improving the use experience of the user.

In some examples, the step 103, that is, the adjusting the display brightness value of the at least one display screen according to the use state information, may include:

determining one of the display screens as a target display screen according to the use state information; and controlling a display brightness value of the target display screen, and adjusting display brightness values of other display screens according to the display brightness value of the target display screen.

In the examples, by determining one of the display screens as the target display screen according to the use state information, the display brightness value of the target display screen is adjusted, and the brightness values of other display screens are adjusted according to the display brightness value of the target display screen.

It is understandable that the brightness value of the target display screen has a correspondence with the brightness value of the remaining display screen. In some examples, there is a predetermined difference relationship between the brightness value of the target display screen and the brightness value of the remaining display screen. For example, the brightness value of the target display screen is 500 lux, and the brightness value of the remaining display screen is 100 lux. In practical applications, such as the aforementioned photographing scenarios and payment scenarios, the target display screen can be set to have a high brightness value requirement, while the remaining display screen does not have the high brightness value requirement. In the examples, the brightness value of the remaining display screen can be adjusted to a brightness value corresponding to the brightness value of the target display screen according to this correspondence. In addition, in other examples, the brightness value of the target display screen may be equal to the brightness value of the remaining display screen.

In the examples, by using the state information, one of the display screens is determined as the target display screen, and while the brightness value of the target display screen is controlled, the brightness value of the remaining display screen can also be adjusted according to the brightness value of the target display screen, so that although the brightness values of multiple display screens of the mobile terminal can be controlled independently, there is still a dependence of the brightness value adjustments for multiple display screens, which can meet various needs of users, reduce manual operations of the users, and improve the use experience of the mobile terminal.

Here, the determining one of the display screens as the target display screen according to the use state information may include: determining that a display screen whose use state information satisfies a preset condition is the target display screen according to the use state information.

In some examples, the display screen satisfying the preset condition may include at least one of the following:

a display screen whose use state information indicates the bright screen state;

a display screen whose use state information indicates the first specific application is displayed; and a display screen whose use state information indicates the specific page of the second specific application is displayed.

Here, by defining that the use state information of the display screen as the bright screen state satisfies the preset condition, it means that the display screen is considered as the target display screen only when the display screen is the bright screen, and then the brightness of the target display screen is adjusted. In this way, on the one hand, it can reduce unnecessary adjustments in some scenarios, such as when the display screen is in the sleep state. On the other hand, by adjusting the brightness of the target display screen in the bright screen state, the user can watch the adjusted brightness change on the bright display screen, so as to select an appropriate brightness, so that the display brightness of the display screen can be more accurately adjusted, reducing the problem of inaccurate adjustment for the bright display screen, and improving the accuracy of the display brightness adjustment.

The first specific application here may be the large competitive game application or the text or light life application, as mentioned above. By defining that the use state information of the display screen indicating the first specific application is displayed satisfies the preset condition, it means that the examples can adjust the brightness of the display screen for displaying the first specific application, and can adjust the brightness value of the remaining display screen according to the brightness value of the display screen displaying the first specific application, so that the brightness value of the remaining display screen can also match a current use scenario of the first specific application, which is conducive to the user's visual experience and use experience.

The specific page of the second specific application here may be, for example, a page where the two-dimensional code in a mobile payment application is locate, as mentioned above. By defining that the use state information of the display screen indicating the specific page of the second specific application is displayed satisfies the preset condition, it means that the examples can adjust the brightness of the display screen for displaying the specific page of the second specific application, and can adjust the brightness value of the remaining display screen according to the brightness value of the display screen displaying the specific page of the second specific application, so that the brightness value of the remaining display screen can also match a current use scenario of the second specific application, which is conducive to the user's visual experience and use experience.

In some examples, the determining one of the display screens as the target display screen according to the use state information may further include:

determining that a display screen where a virtual control on which an input operation has been detected is located is the target display screen.

Figure 2:
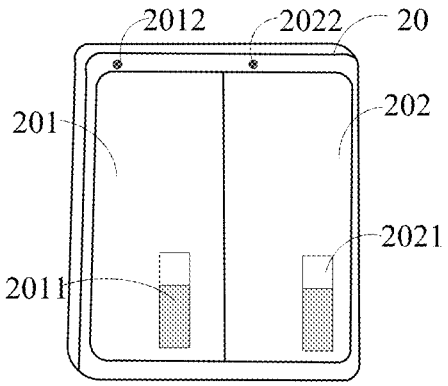
FIG. 2 is a schematic diagram showing an application scenario of a method for adjusting display brightness in accordance with one or more examples of the present disclosure.

Please referring to FIG. 2, which is a schematic diagram of an application scenario of a method for adjusting display brightness in accordance with an example of the present disclosure. As shown in FIG. 2, a mobile terminal 20 which may include a first display screen 201 and a second display screen 202 is taken as an example.

A first virtual control 2011 for brightness adjustment is disposed on the first display screen 201, and a second virtual control 2021 for brightness adjustment is disposed on the second display screen 202. In some examples, the mobile terminal 20 determines the target display screen according to the virtual control on which the input operation has been detected. If the virtual control on which the input operation has been detected is the first virtual control 2011, the mobile terminal 20 determines the first display screen 201 as the target display screen, and if the virtual control on which the input operation has been detected is the second virtual control 2021, the mobile terminal 20 determines the second display screen 202 as the target display screen.

In this way, in the examples, by determining that the display screen where the virtual control on which the input operation has been detected is located is the target display screen, the target display screen can be found conveniently and quickly.

In other examples, the determining one of the display screens as the target display screen according to the use state information may further include:

obtaining an external environment light brightness value, and determining a display screen that has detected that brightness change amount of external environment light brightness is greater than a preset brightness amount as the target display screen according to the external environment light brightness value.

Here, please referring to FIG. 2 again, the mobile terminal 20 which may include the first display screen 201 and the second display screen 202 is taken as an example, as shown in FIG. 2.

A first light sensor 2012 is disposed on the first display screen 201, and a second light sensor 2022 is disposed on the second display screen 202. In some examples, according to the detected external environment brightness, the mobile terminal 20 determines the first display screen 201 as the target display screen if a light sensor that has detected that the brightness change amount of the external environment brightness is greater than the preset brightness amount is the first light sensor 2012, and determines the second display screen 202 as the target display screen if the light sensor that has detected that the brightness change amount of the external environment brightness is greater than the preset brightness amount is the second light sensor 2022.

In this way, in the examples, by determining a display screen where the light sensor that has detected that the brightness change amount of the external environment brightness is greater than the preset brightness amount is located as the target display screen according to the brightness adjustment event, the target display screen can be found conveniently and quickly.

In the above examples, since the target display screen can be determined, that is, the target display screen can be determined based on the current scenario that needs to be adjusted, and the brightness value of the target display screen can be controlled, and then the brightness value of the remaining screen can be adjusted according to the brightness value of the target display screen. For example, the target display screen is determined through the use state information of the display screen; or the target display screen is determined by detecting the input operation for brightness adjustment, or by detecting the display screen where the light sensor is located. And then the brightness value of the target display screen is adjusted, for example, the brightness is brightened, and the brightness value of the remaining display screen is adjusted according to the brightness value of the target display screen, for example, the brightness is darkened. In this way, there is no need for the user to perform additional instruction control. Therefore, even if an original brightness adjustment instruction is used, independent control can be achieved without influencing each other. It reduces the poor visual experience caused by simultaneous brightening or simultaneous darkening, and the energy consumption caused by unnecessary brightness. In addition, it is simple and feasible for implementation, and can make the mobile terminal more intelligent.

Figure 3:
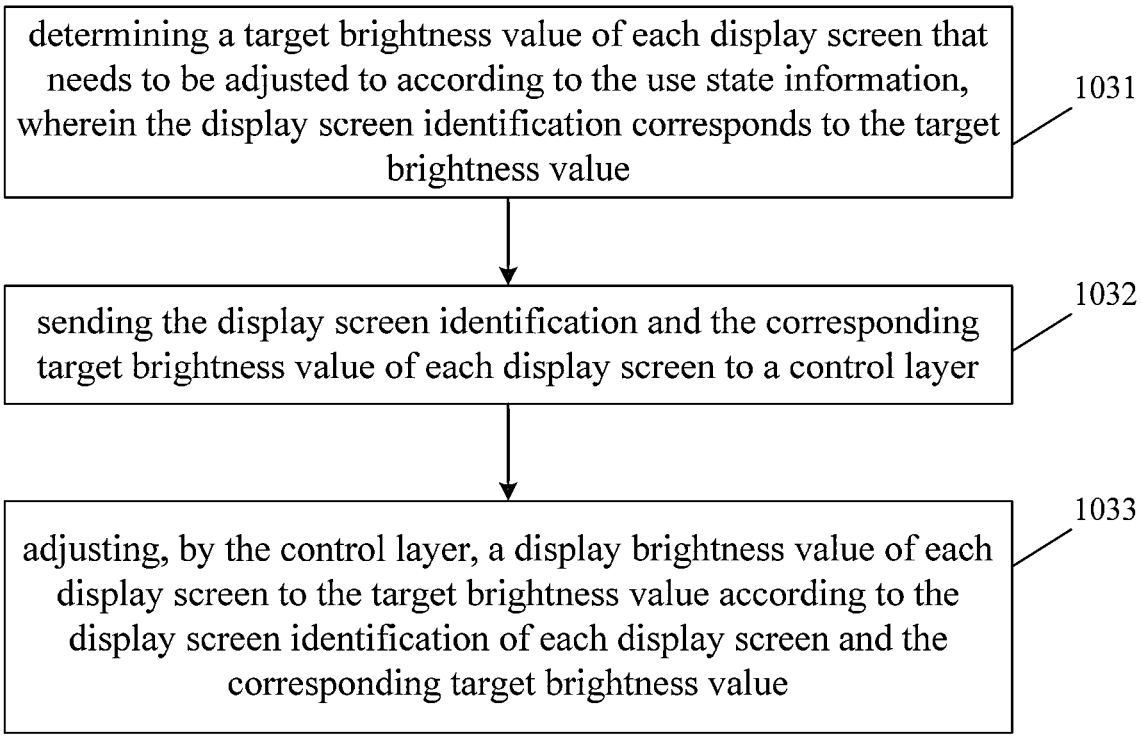
FIG. 3 is a flowchart showing a method for adjusting display brightness in accordance with one or more examples of the present disclosure.

In some examples, please referring to FIG. 3, which is a flowchart showing a method for adjusting display brightness in accordance with an example of the present disclosure. As shown in FIG. 3, the step 103, that is, the adjusting the display brightness value of the at least one display screen according to the use state information, may include:

in step 1031, a target brightness value of each display screen that needs to be adjusted to is determined according to the use state information, and the display screen identification corresponds to the target brightness value;

in step 1032, the display screen identification of each display screen and the corresponding target brightness value are sent to a control layer; and in step 1033, the control layer adjusts a display brightness value of each display screen to the target brightness value according to the display screen identification of each display screen and the corresponding target brightness value.

It should be noted that the control layer may be a part of a kernel layer and is configured to execute instructions or commands provided by an application layer and/or a framework layer. Here, what the control layer receives is the brightness adjustment instruction generated by the brightness adjustment event, and the determined display screen identification of the target display screen for brightness adjustment.

Here, the display screen identification can be identified with a logical screen, that is, a logical screen identification corresponds to the display screen one-to-one. For example, a logic screen 1 is used to identify a first display screen, and a logic screen 2 is used to identify a second display screen. Please note that the display screen identification can also be identified with other letters or numbers. In short, any identification information that can distinguish different display screens can be used.

In the examples, by sending the target brightness value and the display screen identification corresponding to the target brightness value to the control layer for the control layer to control each display screen to adjust the display brightness value of each display screen to the corresponding target brightness value, the independent control of the brightness adjustment for each display screen is achieved.

In the above examples, by adjusting the display brightness value of the at least one display screen according to the use state information of the display screen under the specific application mode, the display brightness value of the corresponding display screen is adjusted according to the use state information, that is, achieving the independent brightness adjustment. In contrast, in the related art, for the mobile terminal including the at least two display screens, when the brightness adjustment event is monitored, the display brightness of all display screens is adjusted. Accordingly, compared to the related art, the examples of the present disclosure can independently control the display brightness of the multiple display screens, reducing the problem of poor experience caused by simultaneous adjustment of all display screens, for example, the problem of unclear display of the display screen other than the target display screen caused by simultaneous darkening, and the glare problem of the display screen other than the target display screen caused by the simultaneous brightening. In addition, since the examples of the present disclosure can independently control the display brightness of the multiple display screens, energy waste caused by unnecessary display brightness can be reduced, and an endurance capability of the mobile terminal can be improved. Moreover, the examples of the present disclosure intelligently adjust the display brightness based on the use state information, and do not require the user to manually perform an independent brightness adjustment operation, which is beneficial to the user's use experience and further improves the use experience of the mobile terminal.

It should be added that in some scenarios, for example, when the mobile terminal takes a picture, it is only necessary to adjust the brightness of a display screen where the preview page is located. For example, for the double-screen mobile phone, in a case where the mobile phone takes the picture, if the photographed subject wants to preview the picture, a display screen where the picture is located can be brightened, while the other display screen may maintain the original display brightness. Alternatively, in other scenarios, for example, when the mobile terminal makes a mobile payment, the double-screen mobile phone is still taken as an example, the two-dimensional code for payment is typically displayed on the rear display screen of the double-screen mobile phone. In order that a scanner can clearly scan the two-dimensional code, the display brightness of the display screen where the two-dimensional code is located can be brightened, while the display screen that does not display the two-dimensional code can maintain the original display brightness, so that the user can watch it normally. For the above two scenarios, when the display brightness is adjusted in the related art, the display brightness of all display screens of the mobile terminal is adjusted, which is obviously not conducive to the user's visual experience of the display screen other than the target display screen of the mobile terminal, and the power consumption is caused due to the increased brightness of the display screen other than the target display screen.

Based on this, in the examples of the present disclosure, when it is detected that the specific application mode has been entered, that is, detecting that a starting mode of a camera application or a starting mode of the payment application has been entered, the display brightness value is adjusted according to the use state information of the display screen, that is, according to the currently displayed content information of the display screen, for example, according to whether to display the specific page of the camera application, such as the preview page, the two-dimensional code page of the payment application. On the one hand, it is conducive to the user's visual experience, while reducing the power consumption caused by the simultaneous brightening in these two scenarios, and improving the endurance capability of the mobile terminal. On the other hand, the brightness value adjustment of each display screen can be intelligently performed according to the use state information of the display screen without the user operation, which is beneficial to the user's use experience, thereby improving the use experience of the mobile terminal.

Further, the present disclosure also provides a specific example to further explain the method for adjusting display brightness provided by the examples of the present disclosure.

In the related art, even if the mobile terminal has the multiple display screens, it uses the unified global brightness adjustment, and it is impossible to achieve independent brightness control for the different display screens.

Figure 4:
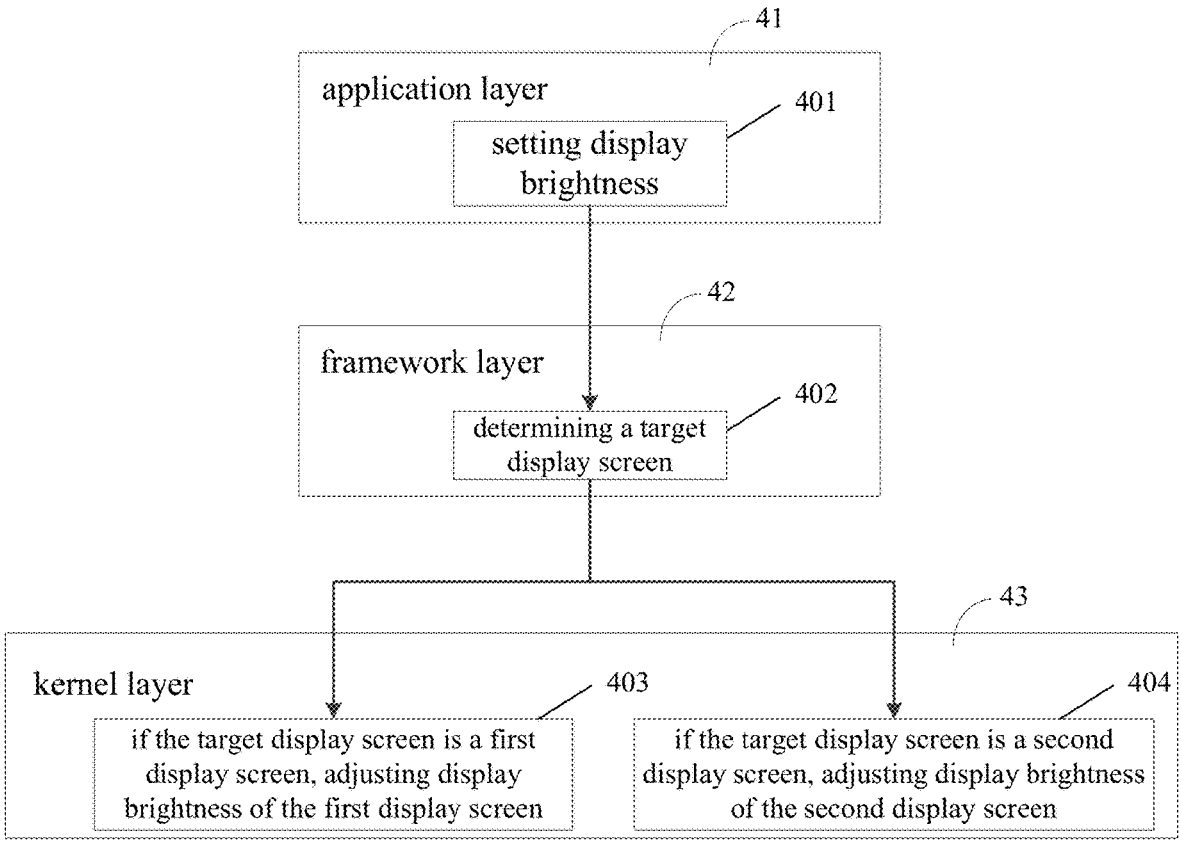
FIG. 4 is a diagram showing a method for adjusting display brightness and a corresponding technical framework in accordance with one or more examples of the present disclosure.

Based on this, please referring to FIG. 4, which is a diagram showing a method for adjusting display brightness and a corresponding technical framework according to an example, and as shown in FIG. 4:

In step 401, display brightness is set.

It should be noted that, the setting the display brightness in the step 401 may be the detecting that the specific application mode has been entered described in the above examples, for example, detecting that the first specific application or the specific page of the second specific application has been entered. In addition, it may also be that the brightness adjustment instruction has been detected, and the brightness adjustment instruction is, for example, triggered based on the input operation of the brightness adjustment control, or triggered based on the light sensor detecting that the brightness value change amount of the external environment light is greater than the preset change amount In some examples, the setting the display brightness here may be performed on an application layer 41. For example, the brightness adjustment detected on the virtual control of the display screen is the brightness setting performed on the application layer.

In step 402, the target display screen is determined.

It should be noted that the determination of the target display screen here is performed on a framework layer 42. The determining the target display screen in the step 402 may be the determining the target display screen according to the use state information of the display screen as described in the foregoing examples.

As an optional example, the determining the target display screen may further include: determining that a display screen displaying the first specific application is the target display screen; or, determining that a display screen displaying the specific page of the second specific application is the target display screen. For example, when the user uses the double-screen mobile phone to take the picture, in order to enable the photographed subject in front to preview the picture, the display brightness of the display screen where the preview picture is located needs to be brightened. In this way, when it is detected that the camera application is started, and the picture preview page of the camera application is enabled, the display screen displaying the picture preview page is determined as the target display screen. For another example, when the user uses the double-screen mobile phone to make a code-scanning payment, in order to protect privacy, the two-dimensional code page is temporarily displayed on the rear screen or the secondary screen in general, and in order to make the scanning success rate higher, it is necessary to brighten the display screen where the two-dimensional code is located. In this way, when it is detected that the two-dimensional code page of the payment application is activated, the display screen where the two-dimensional code page is located is determined as the target display screen. In this way, it is conducive to the user's use experience, and since only the target display screen can be brightened and other display screens can be adjusted according to original rules, or can be adjusted according to the display brightness value of the target display screen, it can be beneficial to the user's visual experience, save the overall energy consumption of the mobile terminal, and improve the endurance capability of the mobile terminal.

In step 403, if the target display screen is the first display screen, the display brightness of the first display screen is adjusted;

In step 404, if the target display screen is the second display screen, the display brightness of the second display screen is adjusted.

Here, the adjusting the display brightness of the target display screen may be completed by a kernel layer 43. In some specific examples, the kernel layer 43 may include the control layer described above.

In the examples, if the target display screen is the first display screen, the target brightness is sent to the control layer according to the logical screen identification that identifies the first display screen, and the control layer controls the first display screen, and adjusts the display brightness of the first display screen to the target brightness.

If the target display screen is the second display screen, the target brightness is sent to the control layer according to the logical screen i identification that identifies the second display screen, and the control layer controls the second display screen, and adjusts the display brightness of the second display screen to the target brightness.

In the examples, different brightness settings for different display screens are implemented, and the brightness adjustment is no longer a unified brightness adjustment mode. In this way, the power consumption impact and visual impact caused by unnecessary brightness can be reduced. In addition, for the user, since the target display screen to be adjusted can be determined intelligently, it is also more intelligent and convenient to use, and the user experience is improved.

Figure 5:
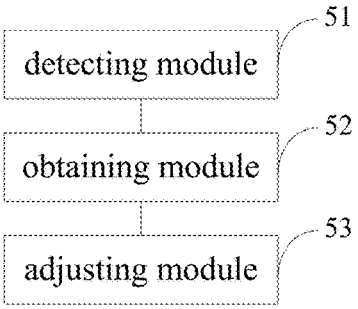
FIG. 5 is a block diagram showing a device for adjusting display brightness in accordance with one or more examples of the present disclosure.

FIG. 5 is a block diagram showing a device for adjusting display brightness in accordance with an example of the present disclosure. With reference to FIG. 5, the device is applied to a mobile terminal including at least two display screens, and includes: a detecting module 51, an obtaining module 52, and an adjusting module 53;

the detecting module 51 is configured to detect that a specific application mode has been entered;

the obtaining module 52 is configured to obtain use state information of the at least two display screens; and the adjusting module 53 is configured to adjust a display brightness value of at least one display screen according to the use state information.

In an optional example, the detecting module 51 is further configured to:

detect that a trigger event has occurred, and the trigger event is in response to the mobile terminal having entered the specific application mode, and the specific application mode needs the at least two display screens to display different display brightness values, and the at least two display screens display different applications, or display different interfaces of the same application.

In an optional example, the obtaining module 52 is further configured to:

identify at least one of current display states and current display content information of the at least two display screens; and determine the use state information according to the at least one of the current display states and the current display content information.

In an optional example, the adjusting module 53 further includes:

a determining sub-module, configured to determine one of the display screens as a target display screen according to the use state information; and an adjusting sub-module, configured to control a display brightness value of the target display screen, and adjust display brightness values of other display screens according to the display brightness value of the target display screen.

In an optional example, the adjusting module 53 is further configured to:

simultaneously adjust display brightness values of all display screens according to the use state information, and different display screens have different display brightness values.

In an optional example, the determining sub-module is further configured to:

obtain an external environment light brightness value, and determine a display screen that has detected that brightness change amount of external environment light brightness is greater than a preset brightness amount as the target display screen according to the external environment light brightness value.

In an optional example, the adjusting module 53 is further configured to:

determine a display screen identification of each display screen;

determine a target brightness value of each display screen that needs to be adjusted to according to the use state information, and the display screen identification corresponds to the target brightness value; and adjust a display brightness value of each display screen to the target brightness value according to the display screen identification of each display screen and the corresponding target brightness value.

Regarding the device in the foregoing examples, a specific manner in which each module performs operations has been described in detail in the method examples, and detailed description will not be given here.

Figure 6:
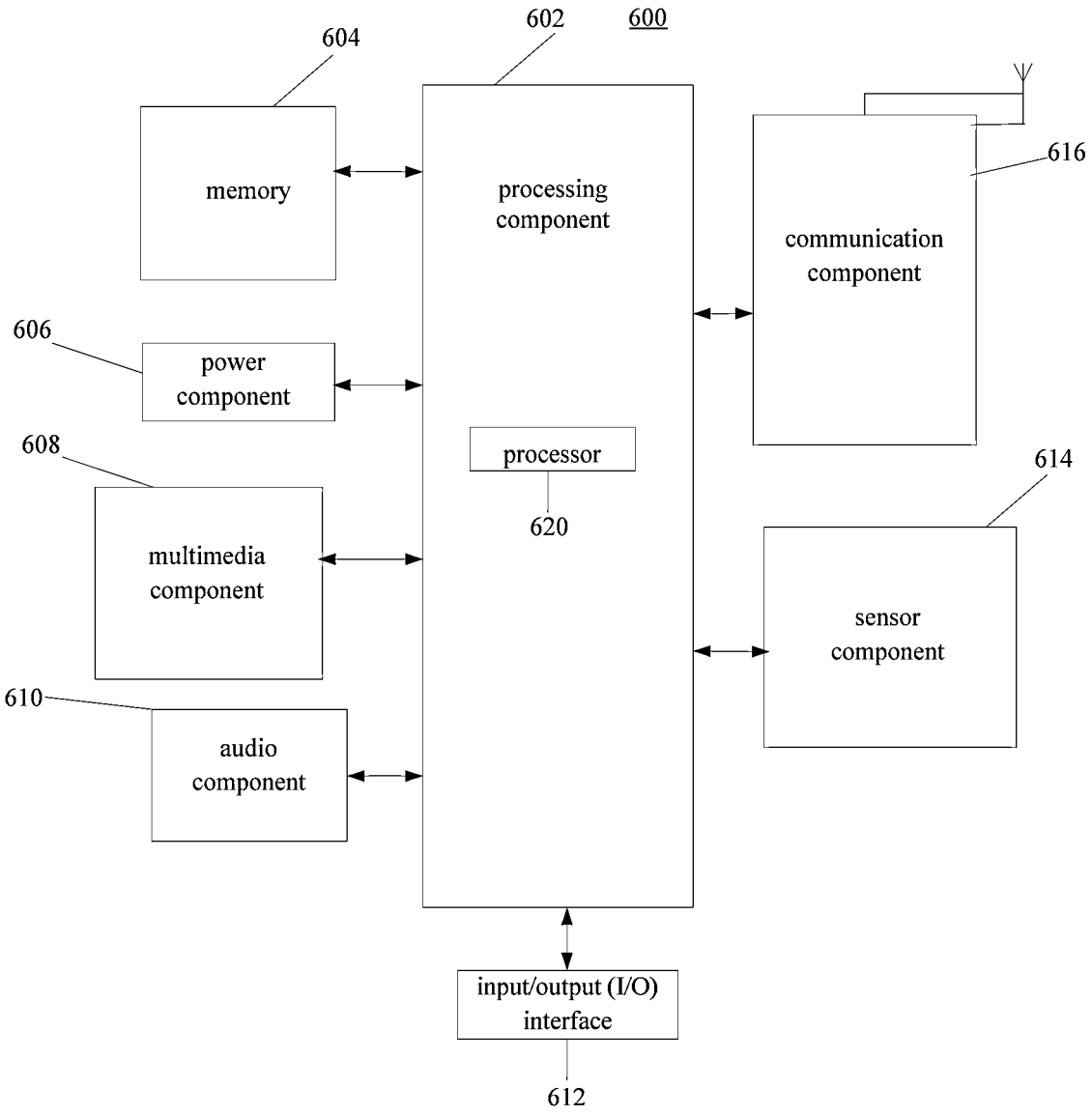
FIG. 6 is a block diagram showing a mobile terminal in accordance with one or more examples of the present disclosure.

FIG. 6 is a block diagram showing a mobile terminal 600 in accordance with an example of the present disclosure. For example, the mobile terminal 600 may be a mobile phone, a computer, a digital broadcasting mobile terminal, a messaging device, a game console, a tablet device, a medical device, a fitness device, a personal digital assistant, etc.

Referring to FIG. 6, the mobile terminal 600 may include one or more of the following components: a processing component 602, a memory 604, a power component 606, a multimedia component 608, an audio component 610, an input/output (I/O) interface 612, a sensor component 614, and a communication component 616.

The processing component 602 typically controls the overall operations of the mobile terminal 600, such as the operations associated with display, telephone calls, data communications, camera operations, and recording operations. The processing component 602 can include one or more processors 620 to execute instructions to perform all or part of the steps in the above described methods. Moreover, the processing component 602 can include one or more modules to facilitate the interaction between the processing component 602 and other components. For example, the processing component 602 can include a multimedia module to facilitate the interaction between the multimedia component 608 and the processing component 602.

The memory 604 is configured to store various types of data to support the operation of the mobile terminal 600. Examples of such data include instructions for any application or method operated on the mobile terminal 600, such as the contact data, the phone book data, messages, pictures, videos, and the like. The memory 604 can be implemented by any type of volatile or non-volatile storage device, or a combination of these, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 606 provides power to various components of the mobile terminal 600. The power component 606 can include a power management system, one or more power sources, and other components associated with the generation, management, and distribution of power in the mobile terminal 600.

The multimedia component 608 includes a screen providing an output interface between the mobile terminal 600 and the user. In some examples, the screen can include a liquid crystal display (LCD) and a touch panel (TP). If the screen includes a touch panel, the screen can be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some examples, the multimedia component 608 includes a front camera and/or a rear camera. When the mobile terminal 600 is in an operation mode, such as a photographing mode or a video mode, the front camera and/or the rear camera can receive external multimedia data. Each of the front camera and the rear camera may be a fixed optical lens system or have focus and optical zoom capability.

The audio component 610 is configured to output and/or input an audio signal. For example, the audio component 610 includes a microphone (MIC) configured to receive an external audio signal when the mobile terminal 600 is in an operation mode, such as a call mode, a recording mode, and a voice recognition mode. The received audio signal may be further stored in the memory 604 or sent via the communication component 616. In some examples, the audio component 610 also includes a speaker for outputting the audio signal.

The I/O interface 612 provides an interface between the processing component 602 and peripheral interface modules, such as a keyboard, a click wheel, buttons, and the like. These buttons may include, but are not limited to, a home button, a volume button, a starting button, and a locking button.

The sensor component 614 includes one or more sensors for providing state assessments of various aspects of the mobile terminal 600. For example, the sensor component 614 can detect an open/closed state of the mobile terminal 600, relative positioning of components, such as the display and the keypad of the mobile terminal 600. The sensor component 614 can also detect a change in position of one component of the mobile terminal 600, the presence or absence of user contact with the mobile terminal 600, an orientation, or an acceleration/deceleration of the mobile terminal 600, and a change in temperature of the mobile terminal 600. The sensor component 614 can include a proximity sensor configured to detect the presence of nearby objects without any physical contact. The sensor component 614 can also include a light sensor, such as a CMOS or CCD image sensor, configured to use in imaging applications. In some examples, the sensor component 614 can also include an accelerometer sensor, a gyroscope sensor, a magnetic sensor, a pressure sensor, or a temperature sensor.

The communication component 616 is configured to facilitate wired or wireless communication between the mobile terminal 600 and other devices. The mobile terminal 600 can access a wireless network based on a communication standard, such as WiFi, 2G or 3G or 4G or 5G, or a combination of those. In an example, the communication component 616 receives broadcast signals or broadcast associated information from an external broadcast management system via a broadcast channel. In an example, the communication component 616 also includes a near field communication (NFC) module to facilitate short-range communications. For example, the NFC module can be implemented based on a radio frequency identification (RFID) technology, an infrared data association (IrDA) technology, an ultra-wideband (UWB) technology, a Bluetooth (BT) technology, and other technologies.

In an example, the mobile terminal 600 may be implemented with one or more application specific integrated circuits (ASICs), digital signal processors (DSPs), digital signal processing devices (DSPDs), programmable logic devices (PLDs), field programmable Gate array (FPGA), controller, microcontroller, microprocessor or other electronic components, and configured to perform the above method.

In an example, there is also provided a non-transitory computer-readable storage medium including instructions, such as a memory 604 including instructions executable by the processor 620 of the mobile terminal 600 to perform the above described method. For example, the non-transitory computer readable storage medium may be a ROM, a random access memory (RAM), a CD-ROM, a magnetic tape, a floppy disc, and an optical data storage device.

There is provided a non-transitory computer-readable storage medium, and instructions in the storage medium, when executed by the processor of the mobile terminal, cause the mobile terminal to execute the method for adjusting display brightness described in the foregoing examples.

Other examples of the present disclosure will be apparent to those skilled in the art from consideration of the specification and practice of the present disclosure disclosed herein. The present disclosure is intended to cover any variations, uses, or adaptations of the present disclosure, which are in accordance with the general principles of the present disclosure and include common general knowledge or conventional technical means in the art that are not disclosed in the present disclosure. The specification and examples are illustrative, and the real scope and spirit of the present disclosure is defined by the appended claims.

It should be understood that the present disclosure is not limited to the precise structures that have been described above and shown in the drawings, and various modifications and changes can be made without departing from the scope of the present disclosure. The scope of the present disclosure is limited only by the appended claims.

What is claimed is:

1. A method for adjusting display brightness, comprising:

detecting, by a mobile terminal comprising at least two display screens, that a specific application mode has been entered;

obtaining use state information of the at least two display screens; and adjusting a display brightness value of at least one display screen according to the use state information, wherein obtaining the use state information of the at least two display screens further comprises:

identifying current display content information of the at least two display screens, wherein the current display content information comprises a currently displayed application or a page of the currently displayed application; and determining the use state information according to the current display content information;

wherein adjusting the display brightness value of the at least one display screen according to the use state information comprises:

determining one of the at least two display screens as a target display screen according to the use state information; and controlling a display brightness value of the target display screen, and adjusting display brightness values of other display screens according to the display brightness value of the target display screen;

wherein determining one of the display screens as the target display screen according to the use state information further comprises:

obtaining an external environment light brightness value, and determining a display screen that has detected that brightness change amount of external environment light brightness is greater than a preset brightness amount as the target display screen according to the external environment light brightness value.

2. The method according to claim 1, wherein detecting that the specific application mode has been entered comprises:

detecting that a trigger event has occurred, wherein the specific application mode has been entered by the mobile terminal in response to the trigger event, and the at least two display screens are needed to display different display brightness values in the specific application mode, and wherein the at least two display screens display different applications, or display different interfaces of a same application.

3. The method according to claim 1, wherein adjusting display brightness value of the at least one display screen according to the use state information comprises:

simultaneously adjusting display brightness values of all display screens according to the use state information, wherein different display screens have different display brightness values.

4. The method according to claim 1, wherein adjusting the display brightness value of the at least one display screen according to the use state information comprises:

determining a display screen identification of each display screen;

determining a target brightness value of each display screen that needs to be adjusted to according to the use state information, wherein the display screen identification corresponds to the target brightness value;

sending the display screen identification of each display screen and the corresponding target brightness value to a control layer; and adjusting, by the control layer, a display brightness value of each display screen to the target brightness value according to the display screen identification of each display screen and the corresponding target brightness value.

5. A mobile terminal, comprising:

a processor; and a memory for storing executable instructions of the processor;

wherein, the processor is configured to execute following operations when executing the executable instructions:

detecting that a specific application mode has been entered;

obtaining use state information of at least two display screens of the mobile terminal; and adjusting a display brightness value of at least one display screen according to the use state information, wherein the processor is further configured to execute following operations:

identifying current display content information of the at least two display screens, wherein the current display content information comprises a currently displayed application or a page of the currently displayed application; and determining the use state information according to the current display content information;

wherein the processor is further configured to execute following operations:

determining one of the at least two display screens as a target display screen according to the use state information; and controlling a display brightness value of the target display screen, and adjusting display brightness values of other display screens according to the display brightness value of the target display screen;

wherein the processor is further configured to execute following operations:

obtaining an external environment light brightness value, and determining a display screen that has detected that brightness change amount of external environment light brightness is greater than a preset brightness amount as the target display screen according to the external environment light brightness value.

6. The mobile terminal according to claim 5, wherein the processor is further configured to execute following operations:

detecting that a trigger event has occurred, wherein the specific application mode has been entered by the mobile terminal in response to the trigger event, and the at least two display screens are needed to display different display brightness values in the specific application mode, and wherein the at least two display screens display different applications, or display different interfaces of a same application.

7. The mobile terminal according to claim 5, wherein the processor is further configured to execute following operations:

simultaneously adjusting display brightness values of all display screens according to the use state information, wherein different display screens have different display brightness values.

8. The mobile terminal according to claim 5, wherein the processor is further configured to execute following operations:

determining a display screen identification of each display screen;

determining a target brightness value of each display screen that needs to be adjusted to according to the use state information, wherein the display screen identification corresponds to the target brightness value; and adjust a display brightness value of each display screen to the target brightness value according to the display screen identification of each display screen and the corresponding target brightness value.

9. A non-transitory computer-readable storage medium having a computer program stored thereon, wherein the program, when executed by a processor, implements following operations:

detecting that a specific application mode has been entered;

obtaining use state information of at least two display screens; and adjusting a display brightness value of at least one display screen according to the use state information, wherein the program, when executed by the processor, further implements the following operations:

identifying current display content information of the at least two display screens, wherein the display content information comprises a currently displayed application or a page of the currently displayed application; and determining the use state information according to the current display content information;

wherein the program, when executed by the processor, further implements following operations:

determining one of the at least two display screens as a target display screen according to the use state information; and controlling a display brightness value of the target display screen, and adjusting display brightness values of other display screens according to the display brightness value of the target display screen;

wherein the program, when executed by the processor, further implements following operations:

obtaining an external environment light brightness value, and determining a display screen that has detected that brightness change amount of external environment light brightness is greater than a preset brightness amount as the target display screen according to the external environment light brightness value.

10. The non-transitory computer-readable storage medium according to claim 9, wherein the program, when executed by the processor, further implements following operations:

detecting that a trigger event has occurred, wherein the specific application mode has been entered by the mobile terminal in response to the trigger event, and the at least two display screens are needed to display different display brightness values in the specific application mode, and wherein the at least two display screens display different applications, or display different interfaces of a same application.

11. The non-transitory computer-readable storage medium according to claim 9, wherein the program, when executed by the processor, further implements following operations:

simultaneously adjusting display brightness values of all display screens according to the use state information, wherein different display screens have different display brightness values.

* * * * *